US005689922A

United States Patent [19]

Daudet

[11] Patent Number: 5,689,922

[45] Date of Patent: Nov. 25, 1997

[54] STRUCTURAL FRAMING SYSTEM

[75] Inventor: Larry Randall Daudet, Schererville, Ind.

[73] Assignee: Dietrich Industries, Inc., Hammond, Ind.

[21] Appl. No.: 785,883

[22] Filed: Jan. 21, 1997

Related U.S. Application Data

[63] Continuation of Ser. No. 381,078, Jan. 31, 1995.

[51] Int. Cl.[6] ..... E04B 2/58

[52] U.S. Cl. ..... 52/210; 52/204.1; 52/204.2; 52/653.1; 52/656.6

[58] Field of Search ..... 52/204.1, 204.2, 52/210, 241, 474, 730.6, 730.3, 731.1, 653.1, 656.1–656.6

[56] References Cited

U.S. PATENT DOCUMENTS

| | | | |
|---|---|---|---|
| 981,937 | 1/1911 | Ohnstrand . | |
| 2,023,814 | 12/1935 | Lindsey . | |
| 2,741,344 | 4/1956 | Herr . | |
| 2,788,098 | 4/1957 | Bianco . | |
| 2,854,843 | 10/1958 | Lamb . | |
| 2,918,994 | 12/1959 | Sylvan . | |
| 3,436,886 | 4/1969 | Nowak . | |
| 3,481,090 | 12/1969 | Lizee | 52/241 X |
| 3,491,501 | 1/1970 | Lundgren . | |
| 3,579,943 | 5/1971 | Tam . | |
| 3,690,082 | 9/1972 | Byland . | |
| 3,769,773 | 11/1973 | Mochizuki . | |
| 3,845,601 | 11/1974 | Kostecky . | |
| 4,038,799 | 8/1977 | Shanks . | |
| 4,067,157 | 1/1978 | Robinson . | |
| 4,188,758 | 2/1980 | Swann | 52/241 |
| 4,235,654 | 11/1980 | Cable et al. . | |
| 4,553,367 | 11/1985 | Redien . | |
| 4,809,476 | 3/1989 | Satchell . | |
| 4,918,899 | 4/1990 | Karytinos | 52/241 X |
| 5,187,909 | 2/1993 | Olson . | |
| 5,313,752 | 5/1994 | Hatzinikolas . | |
| 5,353,560 | 10/1994 | Heydon | 52/474 X |
| 5,412,919 | 5/1995 | Pellock et al. . | |

FOREIGN PATENT DOCUMENTS

| | | | |
|---|---|---|---|
| 0936420 | 9/1963 | United Kingdom | 52/241 |
| 1052074 | 12/1966 | United Kingdom | 52/241 |

*Primary Examiner*—Robert Canfield
*Attorney, Agent, or Firm*—Kirkpatrick & Lockhart LLP

[57] ABSTRACT

Cold formed, light-gauge metal structural framing for building construction, including a one-piece jamb member, a one-piece load-bearing header member connected to said jamb member, and a one-piece upper channel member connected to at least one of said jamb member and said header member and spanning a juncture of said jamb and header members. The framing may also include an expandable, cold formed, light-gauge metal window frame subassembly.

7 Claims, 11 Drawing Sheets

STRUCTURAL FRAMING SYSTEM

This application is a continuation of application Ser. No. 08/381,078 filed on Jan. 31, 1995.

FIELD OF THE INVENTION

The present invention generally relates to building construction systems and, more particularly, to light-gauge metal structural framing systems and components thereof.

BACKGROUND OF THE INVENTION

Because of their strength and versatility, structural framing systems having members fabricated from metal have become prevalent in commercial and industrial building construction. High manufacturing and labor costs, however, have inhibited their use in residential construction. Consequently, by virtue of its comparatively low cost, wood has historically been and remains the structural framing material of preference in this considerable segment of the construction industry.

In both residential and non-residential construction, metal has been used with success in framing doors, windows, panels and similar substantially non-load-bearing building elements. Further, representative disclosures of metal door and window frames may be found, for example, in U.S. Pat. Nos. 981,937, 2,741,344, 2,788,098, 3,436,886, 3,491,501, 3,579,943, 3,690,082, 3,769,773, 4,067,157 and 4,553,367. However, elaborate manufacturing procedures including, inter alia, extruding, stamping, welding and notching have contributed to the design complexity of the individual members of presently known metal door and window frames. That combined with the propensity of such systems to comprise numerous framing and attachment components has resulted in frames that are costly to make as well as install. As a result, at least in respect to residential construction, metal framing systems have been essentially limited to non-structural, i.e., non-load-bearing, window, door and similar frames, which themselves must be installed within larger load-bearing wooden structural frames.

As mentioned previously, and as will be described in greater detail hereinafter, metal framing has been successfully deployed as structural or "load-bearing" framing, typically in commercial and industrial applications. In many ways, these metal structural frames possess many of the disadvantages of their non-structural or "non-load-bearing" counterparts. That is to say, their frame members are commonly formed from a multitude of often times complicated parts whose manufacture is expensive and whose assembly, particularly if additional attachment hardware is also used, is highly labor-intensive.

An advantage exists, therefore, for a light-gauge metal structural framing system of high load-bearing capacity yet comprised of a minimum of simply-designed and economically-manufactured frame elements that may be easily and rapidly installed at a job site.

SUMMARY OF THE INVENTION

The present invention provides a light-gauge metal structural framing system including several novel component features which individually and collectively enhance system performance and durability while simultaneously producing a system that is uncomplicated in design, easy to install and low in cost.

Generally, the framing system comprises one-piece, light-gauge metal jamb members, load-bearing header members and upper channel members preferably fabricated from roll-formed sheet metal or sheet metal formed by other suitable fabrication techniques. The several framing members are formed into relatively simple cross sectional configurations which, when joined to one another, constitute a structural framing system having excellent strength characteristics. Moreover, the various framing components are adapted to readily interengage with one another or with commercially available metal structural framing members of conventional size and shape. Connection of the members therefore requires little skill and may be achieved, according to certain contemplated embodiments, using a minimum of coped flanges or mounting brackets, or, pursuant to other preferred embodiments, completely without such attachment accessories. Through the confluence of these beneficial structural features, production costs (including fabrication, packaging and shipping) as well as labor costs associated with frame assembly are thereby reduced to levels that are comparable with wood structural framing. Also provided is a low-cost, versatile window frame subassembly that is adaptable for use with the aforesaid structural framing system or with other such framing systems heretofore known in the art.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE INVENTION

Figure 1:
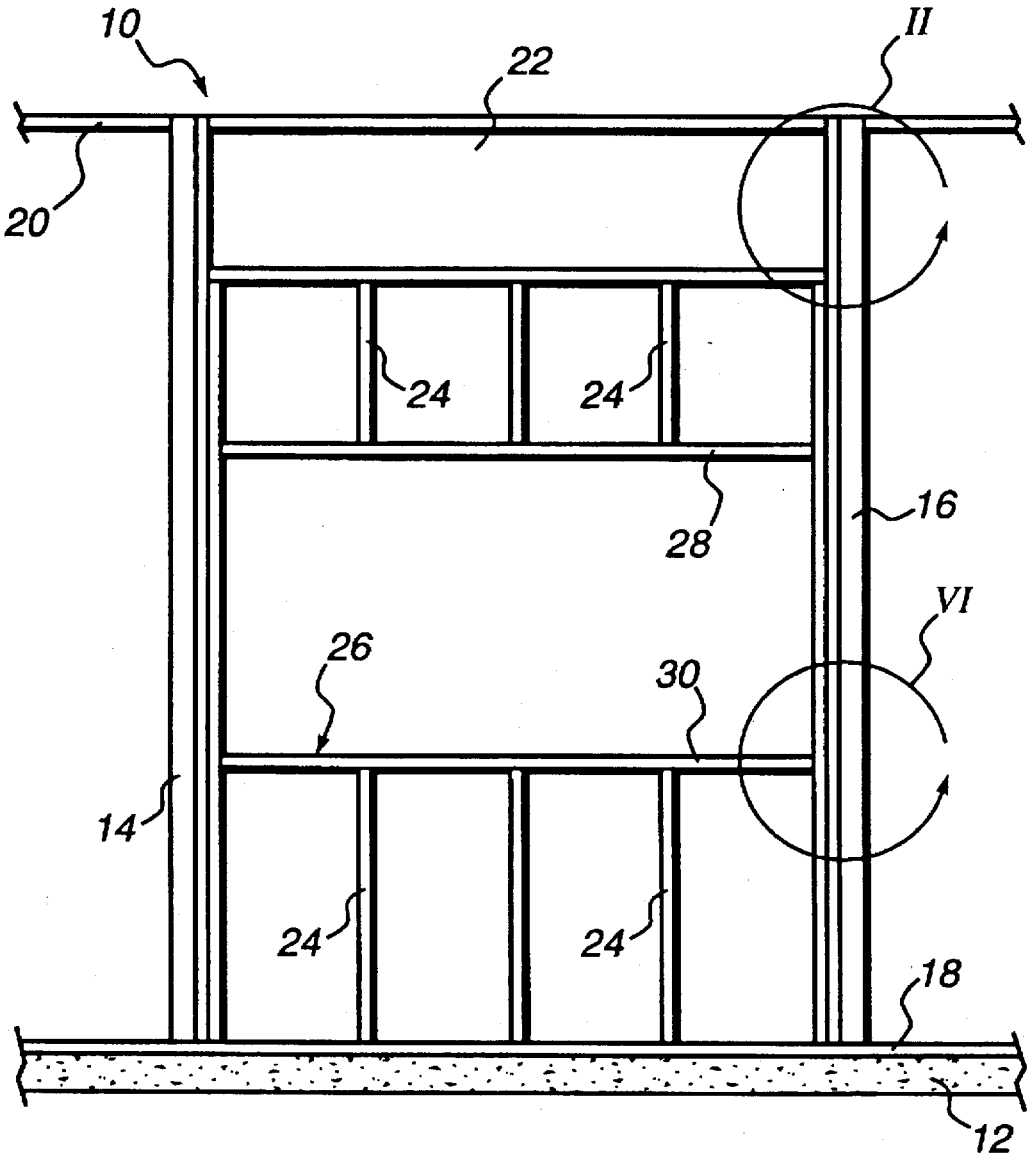
FIG. 1 is an elevational view of a presently known metal structural framing system including a window frame subassembly adapted for use therewith.

In light-gauge metal framing construction, the details of assembling a structural or load-bearing frame, especially those portions adapted to accommodate the non-load-bearing frame of a door, window panel or similar substantially non-load-bearing building element, can be highly labor intensive. A representative example of such a structural frame is shown in FIG. 1.

In that figure, the light-gauge metal structural framing system required for a single non-load-bearing building element is identified generally by reference numeral 10. Framing system 10, as is known, is a segment of a contiguous structural building frame which bears the static, dynamic and other loads exerted by and upon the building structure. Framing system 10 is supported at its base by a subsurface 12 such as a floor or building foundation, and at its top the framing system sustains unillustrated superstructure, e.g., ceiling components, joists, floor slabs, roof structure, and the like, as well as the loads carried by that superstructure. More specifically, framing system 10 includes a pair of opposed load-bearing metal studs or jamb members 14 and 16 which are received at their lower ends in an upwardly-open metallic floor runner 18 secured to the subsurface 12 by suitable fastening means. The upper ends of the jamb members 14 and 16 are received in a downwardly-open metallic ceiling runner 20 which is generally similar in construction to floor runner 18 and is suitably attached to the superstructure.

A load-bearing header member 22 is connected at its opposite ends to the jamb members 14, 16 by any suitable fastening means such as screws, rivets or spot welds. The load-bearing header member functions to distribute structural loadings into the jamb members such that the "infill," or that area beneath load-bearing header member 22 and between the jamb members 14, 16, experiences essentially no structural gravity loads. Normally, arranged between and substantially parallel to the jamb members is a plurality of substantially non-load-bearing studs 24 which may be used to support a building element such as a sheet of drywall, paneling or, as shown, a window frame subassembly which comprises a lateral window header 28 and a lateral window sill 30. The term "lateral" in the present context means that the window header and sill 28, 30 support substantially no structural loads but are sufficiently strong to bear comparatively minor loads, e.g., wind loads or the like, applied generally perpendicular to the plane of the window (or other building element to be framed).

Presently, with existing metal stud products having generally channel-like cross-sectional configurations (commonly known as C-stud products), building panel opening framing frequently requires as many as 17 separate pieces that need to be assembled in the field. Further, each assembly operation typically involves three or four different tasks including, but not limited to, measuring, cutting, clamping and screwing.

Figure 3:
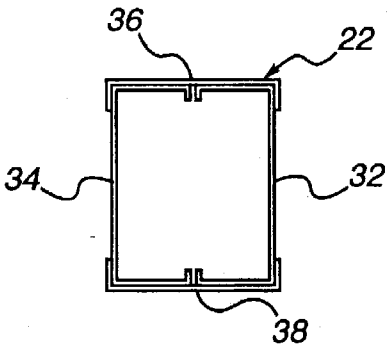
FIG. 3 (Prior Art)
FIG. 3 is an end view of a header member of the metal structural framing system of FIG. 1 as seen from line III—III of FIG. 2.
Figure 4:
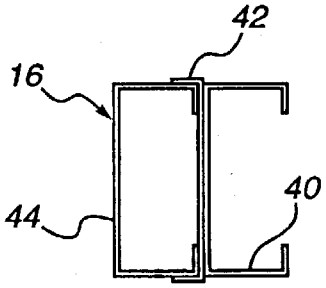
FIG. 4 (Prior Art)
FIG. 4 is an end view of a jamb member of the metal structural framing system of FIG. 1 as seen from line IV—IV of FIG. 2.
Figure 2:
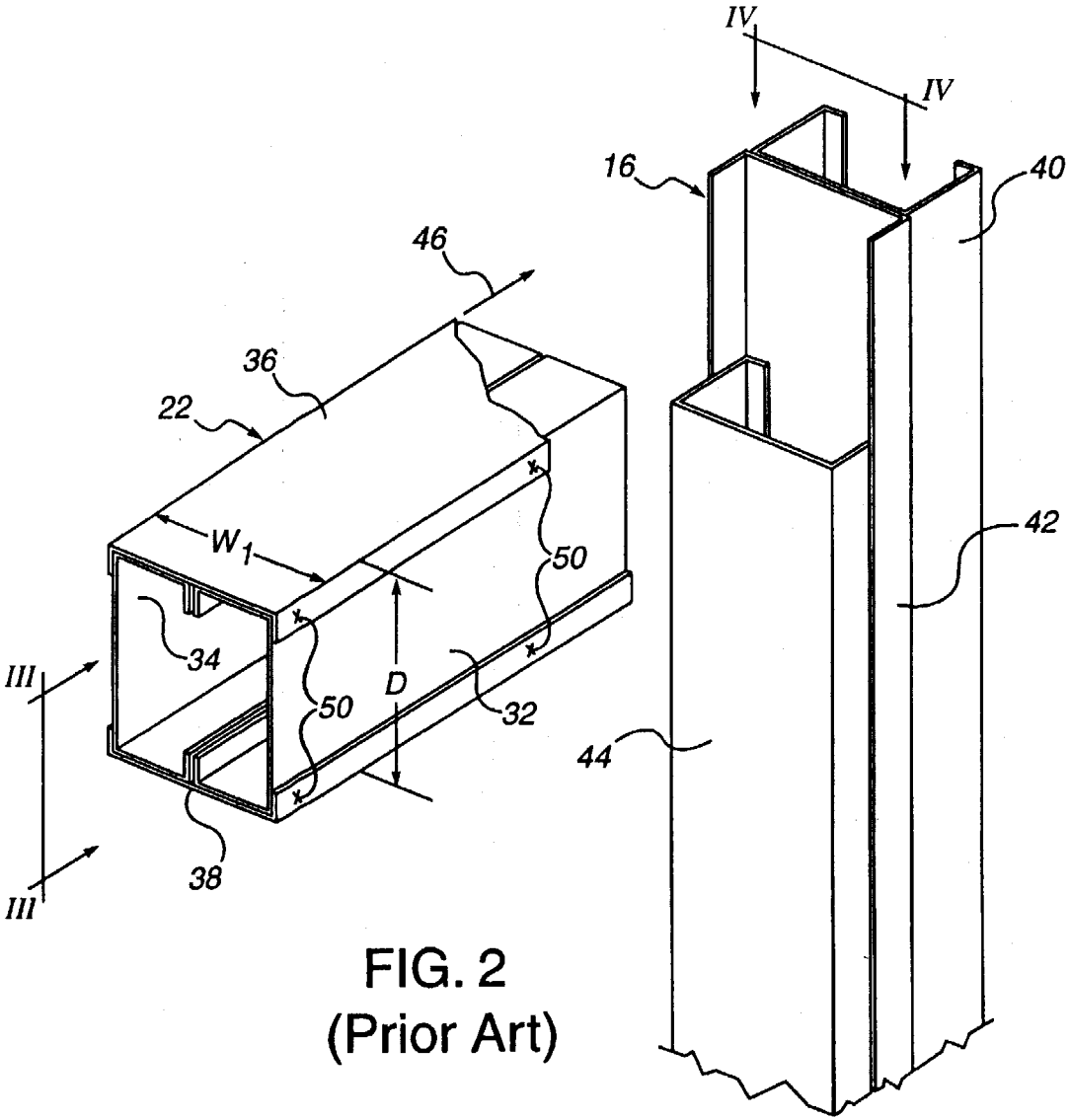
FIG. 2 (Prior Art)
FIG. 2 is an enlarged, exploded view of that portion of the metal structural framing encompassed by arrow II of FIG. 1.

Referring to FIGS. 2 through 4, there is shown the component details of conventional light-gauge metal structural framing for building panel openings which may be used as the framing system 10 in FIG. 1. Hence, like reference characters designate like or corresponding parts throughout the several views. FIGS. 2 and 3, in particular, reveal that the load-bearing header member 22 is fabricated in the form of a tube which consists of four separate pieces, namely, opposed first second substantially C-shaped upright channel pieces 32 and 34 and opposed first and second substantially C-shaped upper and lower channel pieces 36 and 38 which enclose the top and bottom surfaces, respectively, of lateral channel pieces 32, 34.

FIGS. 2 and 4 illustrate the specifics of the conventional light-gauge metal jamb stud or jamb member 16. It will be understood that jamb member 14 is constructed similarly to jamb member 16. The jamb members are typically manufactured from two or, as shown, three separate pieces. These pieces may include first and second oppositely facing substantially C-shaped channel pieces 40 and 42. And, received within and facing opposite piece 42 may be a third substantially C-shaped channel piece 44. Piece 44, as shown in FIG. 2, is cut somewhat shorter in length than pieces 40 and 42, specifically a distance approximately equal to the depth "D" of load-bearing header member 22. The primary purposes for having jamb piece 44 cut to this length is to enable piece 44 to provide vertical structural support for the underside of the header member 22 when that member is connected to the jamb member 16 (or 14), and to ensure that the tops of the jamb member and the header member are substantially flush when those members are joined to one another.

Attachment of the load-bearing header member 22 to the jamb member 16 may be achieved by inserting the header member into the jamb member, as indicated by arrow 46. The width "$W_1$" of the header member is such that it is preferably snugly received within jamb piece 42. Thereafter, the header member is fastened to the jamb member with unillustrated fastening means such as self-tapping screws or the like which connect the opposed flanges of jamb piece 42 to the upright channel pieces 32, 34 of the header member. It will be understood, however, that header member 22 may be joined to the jamb member 16 by spot welding or, alternatively, aligned holes may be drilled into the opposed flanges of jamb piece 42 and the ends of the upright channel pieces 32, 34, whereby rivets or similar fasteners may be inserted into the aligned holes to fixedly connect the header and jamb members.

The header member 22 and the jamb members 14, 16 may be pre-assembled at a manufacturing facility or may be shipped in pieces and assembled at the work site. In either event, assembly of the header member requires the connection of four separate pieces, which may be joined, for example, by screws, rivets, spot welds or other similar fastening means, provided at intermittent locations along flanges of the upper and lower channel pieces 36 and 38, as indicated at 50. Likewise, the various pieces 40, 42 and 44 of the jamb member may be assembled on or off site. Regardless, however, of where and how they may be assembled, a typical frame detail requiring two jamb members such as jamb members 14, 16 and a single header member must be fabricated from ten separate pieces (four header pieces and three jamb pieces at each end of the header), as well as 30 to 40 assembly operations.

Figure 5:
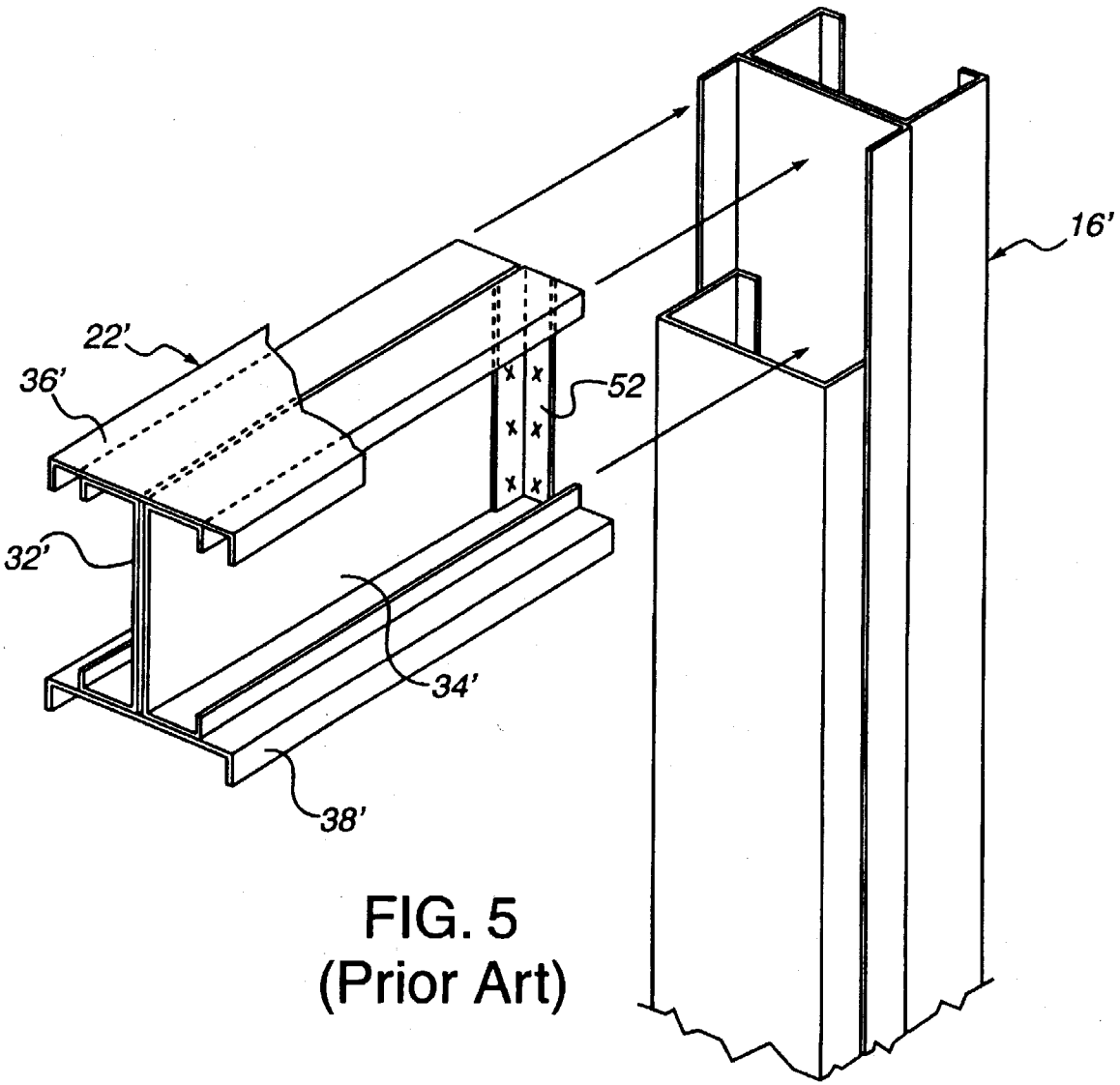
FIG. 5 (Prior Art)
FIG. 5 is an enlarged, exploded view similar to FIG. 2 of an alternative header and jamb construction presently used in metal structural framing systems like that shown in FIG. 1.

FIG. 5 represents an alternative light-gauge metal header and jamb detail which may be used to create the framing system 10 of FIG. 1. In this figure, the jamb member 16' is essentially identical to its counterpart jamb member 16 in FIGS. 2 and 4 and, therefore, will not be described in detail. Indeed, the load-bearing header member, identified herein by reference numeral 22', is generally similar to previously described header member 22. Header member 22' departs from header member 22 in that the orientations of at least two or, as shown, three of its constituent pieces are inverted with respect to those of header member 22. That is, rather than facing toward one another, the openings in the substantially C-shaped upright channel pieces, represented by reference numerals 32' and 34', face away from each other to form a generally I-shaped member in cross-section. Further, the lower channel piece 38' faces downwardly instead of upwardly, as does the upper channel piece 36'.

Although perhaps slightly less cumbersome to assemble than header member 22, header member 22' nevertheless requires an additional connection means 52 (typically a simple, short-length, clip angle member) to effectuate its attachment to jamb member 16' (and to the jamb member at its opposite end). The presence of connection clip 52 at each jamb member adds two pieces and four labor operations to the assembly. Thus, to assemble framing system 10 using the jamb and header members depicted in any of FIGS. 2 through 5 necessarily implicates 30 to 40 (or more) assembly operations.

Assembly is further compounded if one desires to provide a building panel subframe, e.g., a window frame subassembly, within the structural framing. Examples of such structural details are shown in FIGS. 6 and 7.

Figure 6:
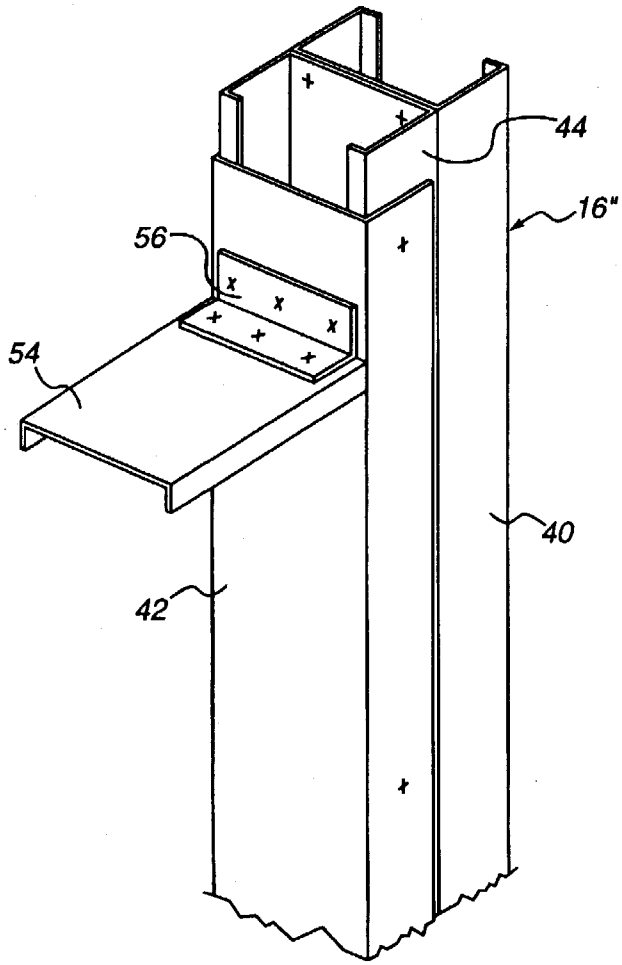
FIG. 6 (Prior Art)
FIG. 6 is an enlarged perspective view of that portion of the metal structural framing and window frame subassembly encompassed by arrow VI of FIG. 1.

Referring initially to FIG. 6, there is illustrated a common method by which a lateral window sill, reference numeral 54, is attached to jamb member 16". Jamb member 16", incidentally, represents an alternative construction to the jamb members 16, 16' described above. That is to say, although having essentially the same constituent components as jambs 16, 16', the positions of jamb channel pieces 42 and 44 of member 16" are reversed vis-a-vis their orientations depicted in FIGS. 2 and 5.

The conventional light-gauge metal window sill 54 is little more than a substantially C-shaped channel member or track that is normally cut to length in the field and attached at its opposite ends to the respective jamb members by an appropriate attachment or connection means 56. According to this embodiment connection means 56, like connection means 52 discussed supra, may consist merely of a short, clip angle member, e.g., a 2"×2"×4", 14-gauge clip angle, with 2 or 3 screws fastening each clip leg respectively to the window sill 54 and the jamb member 16".

Figure 7:
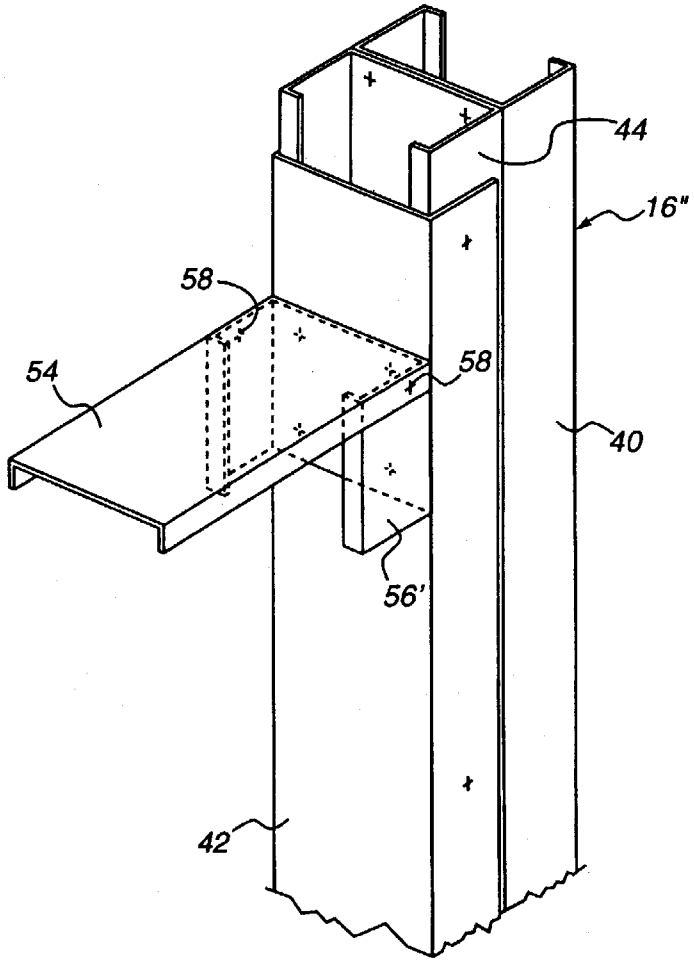
FIG. 7 (Prior Art)
FIG. 7 is an enlarged perspective view similar to FIG. 6 of an alternative attachment scheme for joining a window frame subassembly to the structural framing shown in FIG. 1.

Apart from the means for connecting the window sill 54 to the jamb member 16", which connection means is identified by reference numeral 56', FIG. 7 is otherwise identical to FIG. 6. Connection means 56' is simply a short, perhaps 4- to 6-inch, length of C-stud (which may be a scrap piece from either jamb piece 40, 42 or 44). It is first fastened to jamb piece 42 by suitable fasteners; thereafter, the flanges of the sill 54 and the connection means 56' may be joined at 58 by screws, rivets, spot welds, or the like.

Although not illustrated, the lateral window headers of the window frame subassembly may be attached to the jamb members in essentially the same manner as window sills 54 discussed above. And, for each window sill and window header at least three separate pieces and nine to twelve assembly operations are added to the frame assembly process. In summary, therefore, current detailing methods for installing structural framing and an associated window frame subassembly using light-gauge metal frame components requires as many as 16 to 18 separate pieces and at least 40 to as many as 50 or more labor operations.

In order to make light-gauge metal framing commercially competitive with wood framing, therefore, one must seek to eliminate as many component pieces from the assembly as possible since, apart from reducing manufacturing expense, three to four assembly operations are typically avoided with each piece that is eliminated.

To achieve economics in manufacturing and labor, the present invention offers a simplified light-gauge metal structural framing system which includes one-piece jamb, load-bearing header and upper channel members of relatively uncomplicated design which are easily and rapidly connected to one another in the field. Once installed, the framing system exhibits excellent structural strength and may readily receive a building element such as a window frame subassembly, which subassembly constitutes a further aspect of the present invention. Pursuant thereto, FIGS. 8 through illustrate several presently preferred embodiments of the structural framing system according to the instant invention.

Figure 8A:
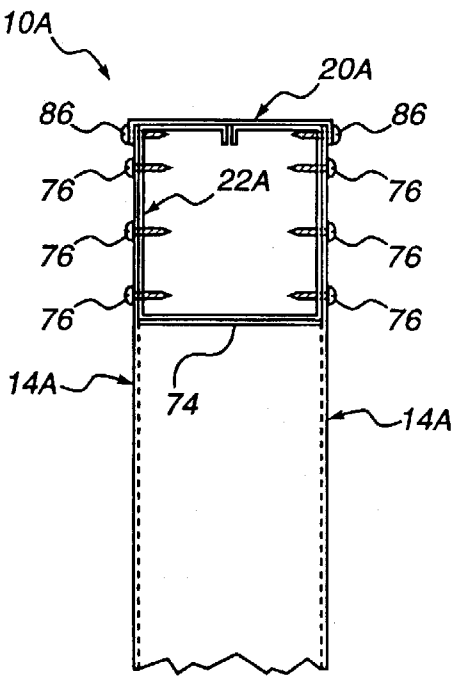
FIG. 8A is a view of the header, jamb, and upper channel construction of FIG. 8 in assembled condition.
Figure 8:
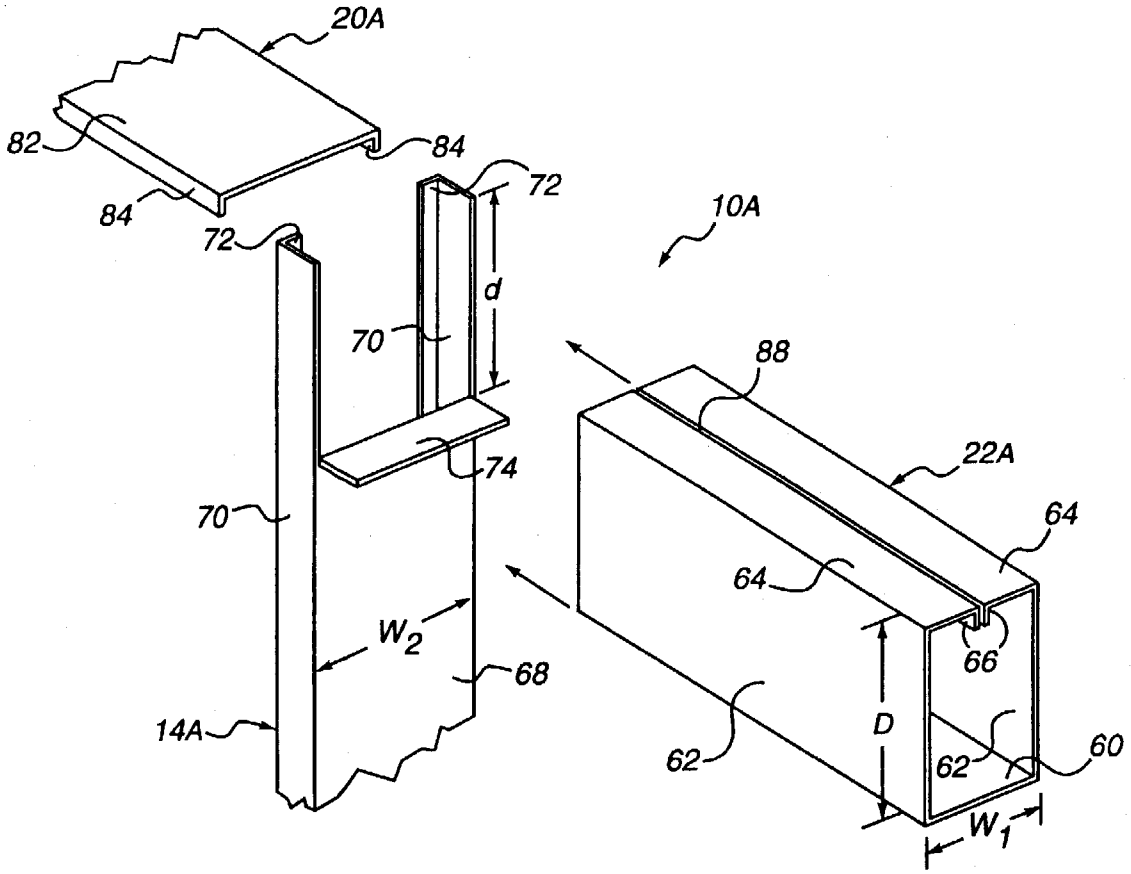
FIG. 8 is an enlarged, exploded view of a header, jamb, and upper channel construction according to a first preferred embodiment of the light-gauge metal structural framing system of the present invention.

Turning to FIGS. 8 and 8A, the structural framing system 10A depicted therein comprises a jamb member 14A, a load-bearing header member 22A and an upper channel member 20A. Each of these members is of unitary construction, i.e., each is a one-piece member fabricated from suitable sheet metal such as steel. In addition, the jamb member 14A, load-bearing header member 22A and upper channel member 20A may be caused to assume their specific cross-sectional configurations using techniques per se known in the art. For instance, a presently preferred method for shaping these framing members is roll bending or roll forming which is a relatively simple, rapid and cost-effective process for working sheet metal stock material. In roll bending, the sheet metal is cold-worked (i.e., it is not heated, thereby reducing energy costs) and it is sequentially passed through a series of roll stations which incrementally bend the metal sheet until, upon passing the final roll station, the metal assumes its desired cross-sectional shape. For present purposes, roll bending is the most preferred manner by which to form the framing members in that it is far less material, energy and time intensive than extrusion or stamping processes yet produces components of comparable strength to these other metal forming methods.

In this regard, the load-bearing header member 22A may be fabricated from light-gauge steel including, without limitation, 20-, 18-, 16-, 14- or 12-gauge sheet, which is formed into an elongated, tube-like box beam. Such box beam includes a web portion 60 of width "$W_1$". Width "$W_1$" is dimensioned to be slightly less than the width "$W_2$" of the jamb member 14A whereby the header member may be accommodated within the jamb member, as will be described hereinafter. Contiguous with and upwardly projecting from opposite side edges of the bottom portion are a pair of substantially parallel walls 62, the height of which establishes the depth D of the header member 22A. The depth of the load-bearing header member 22A may be selected from any conventional size such as 6", 8", 10" or 12", or may be manufactured to customized sizes as circumstances, including construction codes, may dictate. Extending inwardly from the top edge of each wall 62 substantially parallel to the web portion 60 is a flange 64. Each flange 64, in turn, terminates in a downwardly turned lip 66 which imparts structural rigidity to its associated flange.

Jamb member 14A may be a commercially available substantially C-shaped steel stud member formed of sheet steel of similar or even lighter gauge than that of the load-bearing header member 22A. The jamb member may thus configured to conventional dimensions or, if desired or necessary, custom dimensions. In the typical case, it is contemplated that jamb member 14A Comprises a web portion 68 having a width "$W_2$". For typical residential constructions, $W_2$ may be about 3½" or 5½", and for ordinary commercial/industrial constructions this distance may be about 3⅝", 6", 8" or 10", although $W_2$ may be increased or decreased as desired for customized installations. The web portion 68 is bounded by opposed flanges 70 typically about 1⅜", 1⅝", 2" or 2½" in height extending substantially perpendicular to the web portion. For rigidity, the jamb member 14A also desirably includes a pair of inwardly directed lips 72 (usually about ⅜", ½" or ⅝" wide) and extending substantially perpendicular to the flanges 70.

In order for the jamb member 14A to receive the load-bearing member 22A, the web portion 68 must be "coped" or cut away from the top of the jamb member downwardly through a distance "d". Distance "d" should approximately equal depth "D" of the header member 22A such that the header member flanges 64 are substantially coplanar with the top of the jamb member when the header is received therein. Desirably, a portion of the coped web portion 68 is preserved and is bent outwardly from the jamb member 14A to form an attachment tab means 74. The attachment tab means 74, in turn, is preferably fastened by suitable means such as self-tapping screws, rivets, spot welds, or the like (not shown) to the lower surface of the header web portion 60. As such, the presence of attachment tab means 74 enhances vertical support for the end of the header member 22A and inhibits detachment of the header from the jamb upon assembly of the framing system. To complete the connection of the load-bearing header member 22A and the jamb member 14A, fastening means, e.g., self-tapping screws 76 (FIG. 8A) are deployed to unite the jamb member flanges 70 and the upright walls 62 of the header member.

The final essential component of structural framing system 10A is the upper channel member 20A. The upper channel member 20A may be any light-gauge steel track having a substantially C-shaped cross section defined by a web portion 82 bound by substantially perpendicular opposed flanges 84. The upper channel may be selected from commercially available stock product or may be specially formed to suit non-standard specifications. The most critical factor in choosing the appropriate channel member, however, is that the width of its web portion 82 must be such that the distance between the opposed inner surfaces of flanges 84 is sufficient to receive, preferably with a snug fit, the outer surfaces of the flanges 70 of the jamb member 14A. As seen in FIG. 8A, fastening means 86 such as self-tapping screws may be used to secure the upper channel member to the header member. Again, any of the aforementioned fastening means may also be used for this purpose.

The upper channel member 20A is of a length sufficient to span the juncture between at least one jamb member 14A and at least one load-bearing header member 22A and, quite commonly, may span several of these framing system junctions. Indeed, the upper channel member 20A may in some circumstances extend for the entire length of a building wall utilizing the framing system 10A. The purpose of the upper channel member 20A is to provide lateral stability at the jamb/header intersection. A similar channel member, as will be discussed in connection with FIG. 12, is also provided at the base of the framing system 10A and receives the bottom ends of one or more jamb members.

Also, in accordance with the embodiment of the load-bearing header member depicted in FIG. 8, a gap 88 is formed between the rigidifying lips 66. If desired, prior to placement of the upper channel 20A into its final position, suitable thermal insulation means such as spray foam insulation may be introduced into the gap 88 to improve the insulative characteristics of the assembled structural system framing 10A.

Figure 9A:
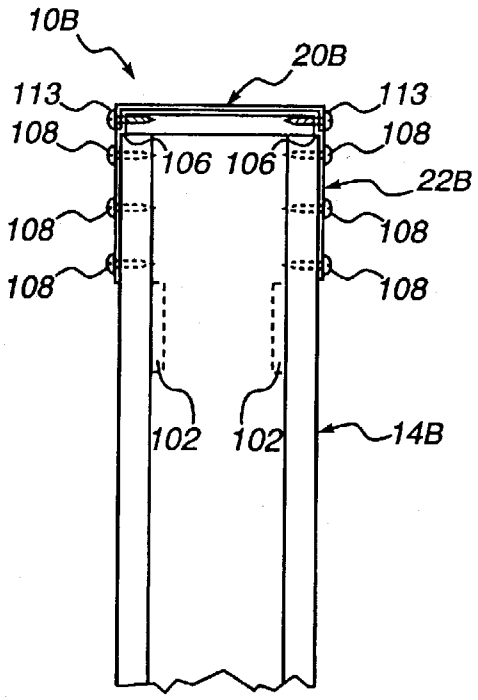
FIG. 9A is a view of the header, jamb, and upper channel construction of FIG. 9 in assembled condition.
Figure 9:
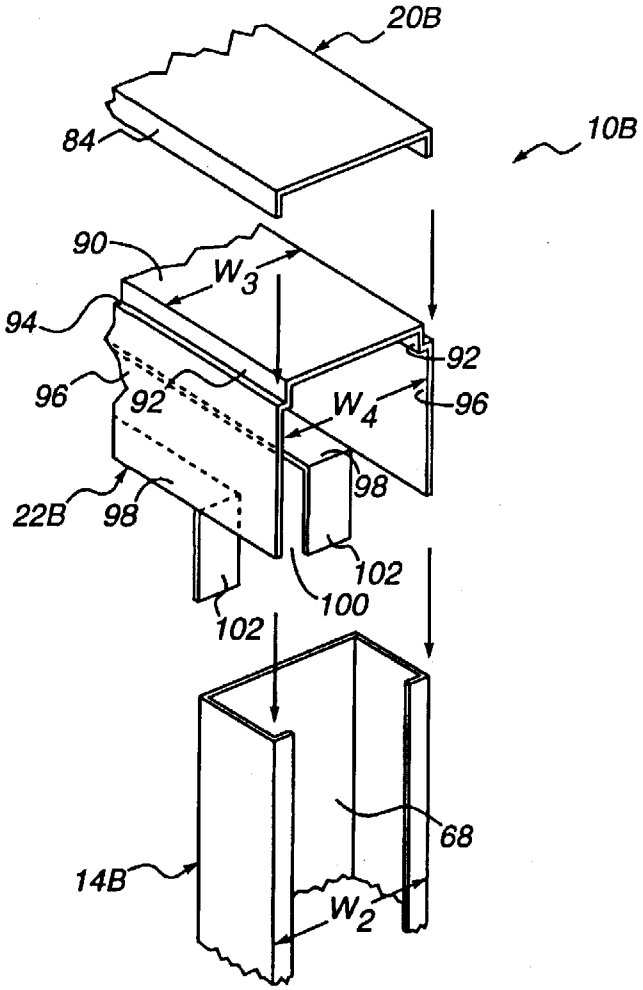
FIG. 9 is an enlarged, exploded view similar to FIG. 8 of a light-gauge metal header, jamb, and upper channel construction according to a further preferred embodiment of the present invention.

Referring to FIGS. 9 and 9A, there is shown a further preferred embodiment of the light-gauge metal structural framing system of the present invention, identified generally by reference numeral 10B. As with framing system 10A discussed supra, framing system comprises a one-piece jamb member (reference 14B), a one-piece load-bearing header member (reference 22B) and a one-piece upper channel member (reference 20B). Except where otherwise indicated, jamb member 14B and upper channel member 20B are constructed and function substantially similarly to their counterparts in FIGS. 8 and 8A. Accordingly, only those aspects of the several components of FIGS. 9 and 9A which depart materially in structure and/or function from those described in connection with FIGS. 8 and 8A, or whose description is otherwise required for a proper understanding of the invention, will be discussed in detail.

Load-bearing header member 22B, like header member 22A, is preferably manufactured from roll formed light-gauge sheet steel, e.g., 20-, 18-, 16-, 14- or 12-gauge sheet. Unlike header member 22A, however, header member 22B is formed to receive jamb member 14B. That is, whereas jamb member 14A of FIGS. 8 and 8A accommodates the header member 22A, it is the header member 22B which accepts the jamb member 14B in the instant embodiment.

Header member 22B comprises a web portion 90 of width "$W_3$" which is preselected to be slightly less than the distance between the downwardly directed flanges of the upper channel member 20B. Depending substantially perpendicularly from and contiguous with the opposite side edges of the web portion 90 are opposed walls including a pair of substantially parallel first wall portions 92. Projecting laterally outwardly from these first wall portions are narrow ledges 94 from which depend a pair of opposed second wall portions 96 disposed generally parallel to the first wall portions 92 and separated by a distance "$W_4$" A pair of inwardly turned flanges 98 are provided at the lower edges of the second wall portions 96 and function to stiffen the header member. Between the flanges 98 is a space 100 through which thermal insulation material may be placed into the interior of the header member 22B, if desired.

Attachment tab means in the form of two tabs 102 may be cut from the end of the header member 22B along the common edges of the second wall portions 96 and the flanges 98 and then bent outwardly from the plane of the flanges. These tabs may be made in the field or at the manufacturing plant. Unillustrated fastening means such as those previously discussed in connection with FIGS. 2, 8 and 8A may be used to attach the header member to the web portion 68 of jamb member 14B.

As perhaps most clearly shown in FIG. 9A, the width $W_4$ between the second wall portions 96 of the header member 22B is sufficient to accommodate the entire width $W_2$ of the jamb member 14B. Further, when jamb member 14B is properly received within the header member 22B, the top of the jamb member comes into abutment with a pair of shoulders 106 established by the undersurfaces of ledges 94. Attachment of the header member 22B to the jamb member 14B may then be effected by any suitable fastening means, such as the illustrated self-tapping screws 108, which operate to connect the second wall portions 96 of header member 22B to the opposed jamb flanges 70. Once these members are joined, the downwardly open upper channel member 20B may then be brought into mating contact with the web portion 90 and first wall portions 92 of the header member 22B. When properly seated, the upper channel member may be affixed to the header member via suitable fastening means 113, e.g., self-tapping screws, joining the flanges 84 of the upper channel member and the first wall portions 92 of the header member.

The framing systems 8, 8A, 9 and 9B require approximately six to eight less framing pieces than existing light-gauge metal structural framing, such as, for example, that shown in FIGS. 1 through 7. And, with this reduction in parts comes the elimination of the multiple assembly steps associated with such pieces. Consequently, these systems offer significant economies in both manufacturing and construction costs. Furthermore, the header, jamb, and upper and lower channel members can be delivered in stock lengths that may be cut to desired lengths at the work site. However, the coped jamb 14A (FIG. 8) or coped header 22B (FIG. 9) complicate installation if the coping is performed in the field. Alternatively, if coped at the factory, such coping would require exact rather than stock lengths to be delivered to the work site, thereby increasing production costs associated with fabrication, packaging and shipping.

Figure 10A:
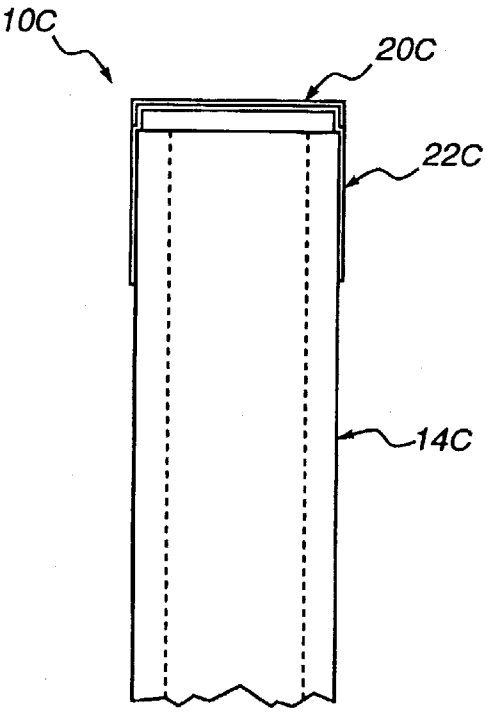
FIG. 10A is a view of header, jamb, and upper channel construction of FIG. 10 in assembled condition.
Figure 10:
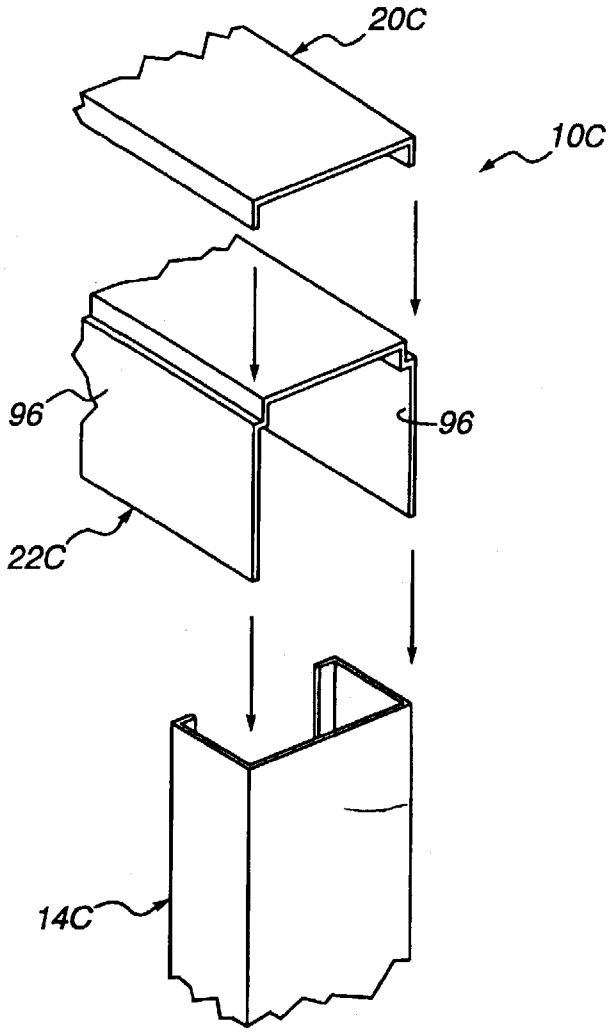
FIG. 10 is an enlarged, exploded view similar to FIG. 8 of a light-gauge metal header, jamb, and upper channel construction according to a further preferred embodiment of the present invention.

FIGS. 10 and 10A represent a further preferred embodiment of the light-gauge metal structural framing system according to the present invention, herein identified by reference numeral 10C. Due to its substantial similarity in manufacture, function and assembly to framing 10B, only those features of framing system 10C which significantly differ from their counterparts in framing system 10B will be addressed in detail.

Framing system 10C constitutes a somewhat simplified version of framing system 10B. Jamb member 14C and upper channel member 20C correspond substantially identically, respectively, to members 14B and 20B of FIGS. 9 and 9A. In addition, the only material difference between the load-bearing header member 22C and its sibling load-bearing header member 22B is in its absence of inturned stiffening lips and attachment tab means at the bottom edge of the second wall portions 96. Otherwise, framing 10C is constructed and assembled in the manner described in connection with framing system 10B.

Figure 11A:
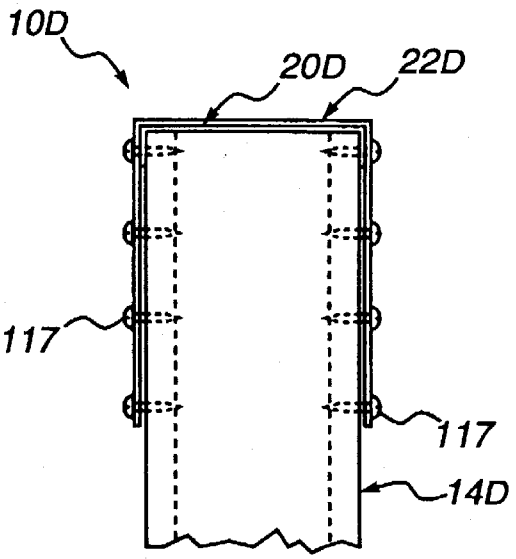
FIG. 11A is a view of the header, jamb, and upper channel construction of FIG. 11 in assembled condition.
Figure 11:
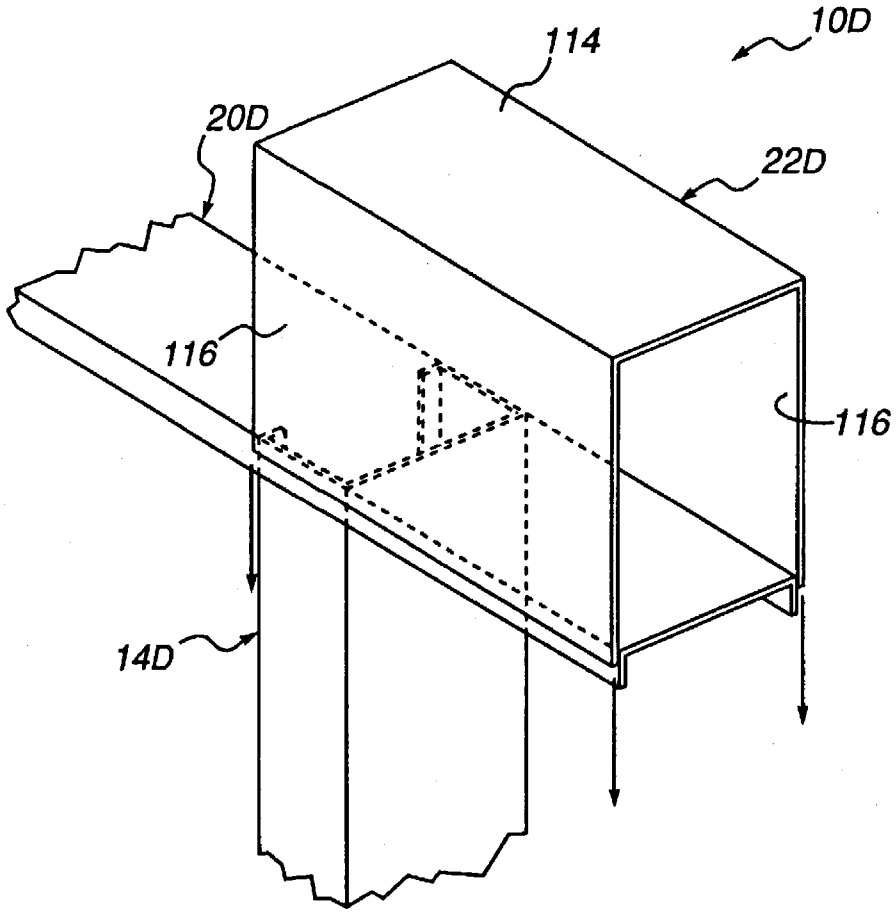
FIG. 11 is an enlarged, exploded view similar to FIG. 8 of a light-gauge metal header, jamb, and upper channel construction according to a further preferred embodiment of the present invention.

The simplest presently contemplated embodiment of the instant invention is shown in FIGS. 11 and 11A wherein the light-gauge metal structural framing system, including one-piece jamb member 14D, one-piece load-bearing member 22D and one-piece upper channel member 20D, is generally identified by reference numeral 10D. Jamb member 14D and upper channel member 20D are constructed substantially the same as jamb members 14A, 14B and 14C described supra; the same is true for upper channel member 20D vis-a-vis upper channel members 20A, 20B and 20C. Hence, specific reference to the jamb member 14D and the upper channel member 20D will be limited in this particular passage to the manner in which those components are disposed relative to one another and to the header member 22D.

Header member 22D includes a web portion 114 bounded by a pair of downwardly extending walls 116, thereby defining a deep, substantially U-shaped channel. Distinct from the embodiments of the framing system thus far described, the upper channel member in system 10D is mounted beneath rather than above the header member. That is, the upper channel member 20D is first attached to the tops of the jamb member 14D and any other predetermined jamb members by unillustrated fastening means. Thereafter, the web portion 114 of header member 22D is brought into abutment with the upper end of jamb member 14D and is fastened to the side flanges thereof and to upper channel member 20D by suitable fastening means 117.

It is also contemplated that the downwardly extending walls 116 of header member 22D may be of a sufficient depth whereby their lowermost edges may overlap and be attached to an upper lateral header member of a window frame subassembly, e.g., member 28 in FIG. 1 or members 144 or 144' in FIGS. 15 or 16 described hereinafter.

Although perhaps the least expensive of the presently proposed framing systems in terms of production costs, framing system 10D, like system 10C, has a lower load bearing capacity than framing systems 10A and 10B because its load-bearing header member lacks any stiffening flanges or lips.

FIGS. 12, 12A, 13 and 14 disclose a further presently preferred embodiment of the light-gauge metal framing system in accordance with the invention. This particular system (reference 10E) again comprises a one-piece jamb member 14E, a one-piece load-bearing header member 22E and a one-piece upper channel member 20E. In addition, FIG. 12 shows the connection of the bottom of the jamb member 14E by fastening means 118 to a lower, upwardly open floor runner member 18E such as a track or channel of conventional construction and dimensions. Runner member 18E, like floor runner 18 of FIG. 1, may be affixed to an unillustrated subsurface by techniques known in the art. All of the members 14E, 22E and 20E are again preferably roll formed from sheet steel having gauge thicknesses generally consistent with the ranges described above in connection with FIGS. 8 and 8A.

Figure 12A:
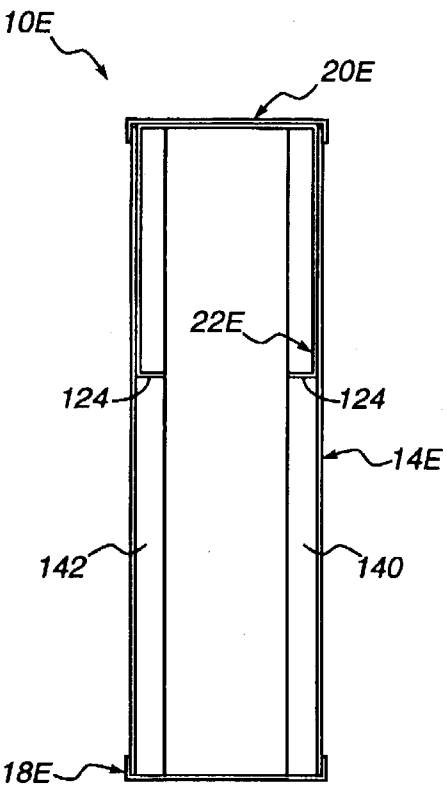
FIG. 12A is a view of the header, jamb, and upper channel construction of FIG. 12 in assembled condition.
Figure 12:
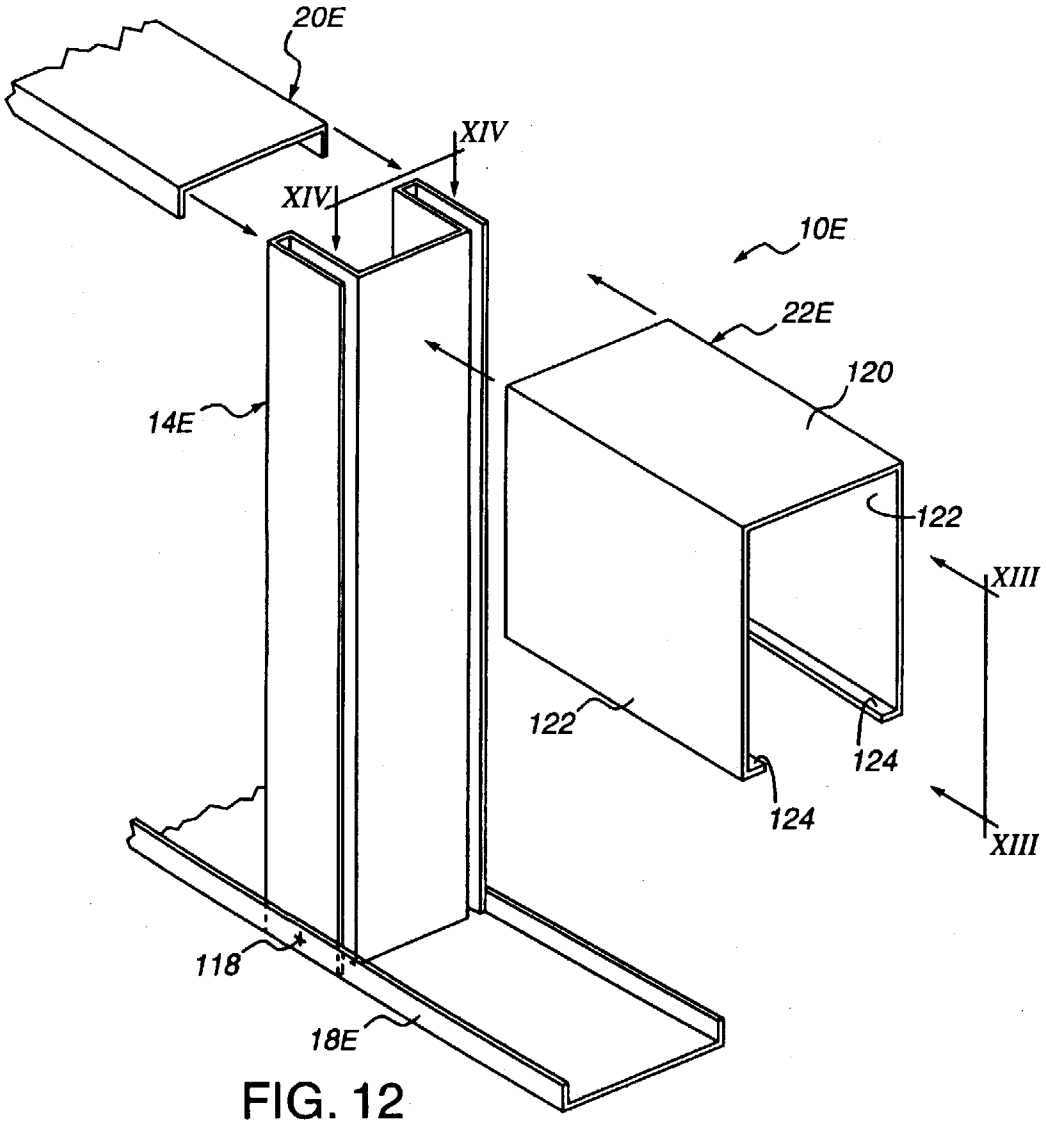
FIG. 12 is an enlarged, exploded view similar to FIG. 8 of a light-gauge metal header, jamb, and upper channel construction according to a further preferred embodiment of the present invention.
Figure 13:
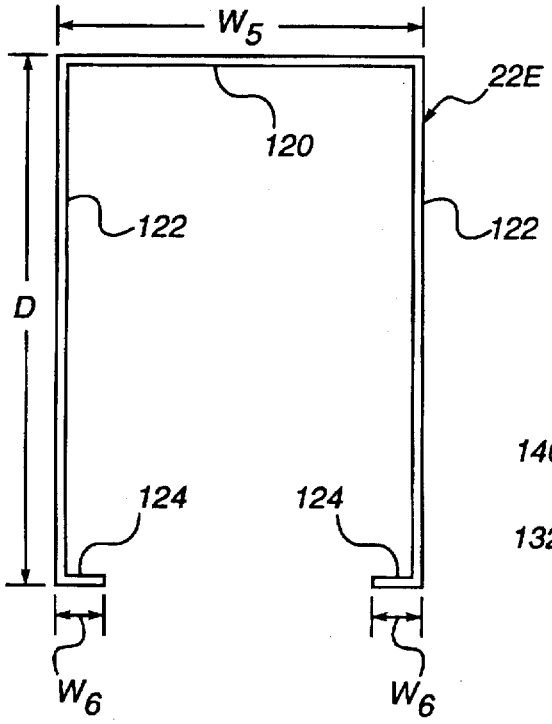
FIG. 13 is an end view of the header member of FIG. 12 as seen from line XIII—XIII of that figure.

As FIGS. 12 and 13 reveal, header member 22E assumes the shape of a tube-shaped box beam. This box beam has a web portion 120 of width "$W_5$". As will be described at greater length hereinafter, width $W_5$ is slightly less than the distance between the inner surfaces of a pair of outer flanges of the jamb member 14E. Contiguous with and downwardly projecting from opposite side edges of web portion 120 are a pair of substantially parallel walls 122, the height of which, D, may typically be 6", 8", 10" or 12", or perhaps some other custom dimension. Extending inwardly from the bottom edge of each wall 122 substantially parallel to the web portion 120 is a rigidifying or stiffening flange 124 of width "$W_6$".

Figure 14:
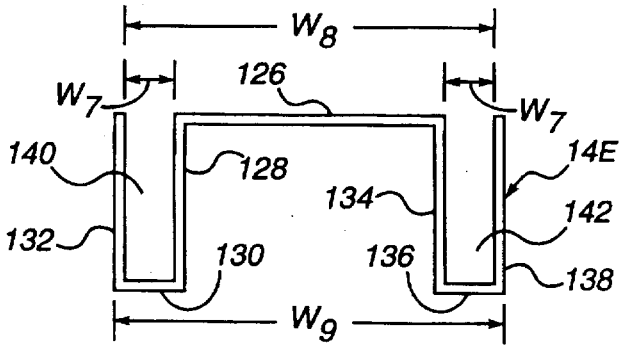
FIG. 14 is an end view of the jamb member of FIG. 12 as seen from line XIV—XIV of that figure.

FIGS. 12 and 14 demonstrate the presently preferred cross-sectional configuration of the jamb member 14E, which configuration is especially well adapted to matingly cooperate with the specific shape of header member 22E. Again, jamb member 14E and load-bearing header member 22E may be fabricated, such as by roll forming, from light-gauge sheet steel of gauge thicknesses consistent with those previously discussed. Likewise, their gross outer dimensions, e.g., width and depth, may be selected to substantially correspond with those of any of their aforementioned counterparts or may be manufactured to any desired specifications.

Jamb member 14E preferably is formed to have a central web portion 126, a first inner flange 128 extending substantially perpendicular to the central web portion, a first outer web portion 130 extending substantially parallel to the central web portion, and a first outer flange 132 extending substantially parallel to the first inner flange. Along the opposite edge of the central web portion the jamb member further comprises a second inner flange 134 extending substantially perpendicular to the central web portion, a second outer web portion 136 extending substantially parallel to the central web portion, and a second outer flange 138 extending substantially parallel to the second inner flange. Although illustrated as being substantially equal in length to the first and second inner flanges 128, 134, the first and second outer flanges 132, 138 may be fabricated to greater or less length than the inner flanges, if desired or necessary.

Together, the first inner flange 128, the first outer web portion 130 and the first outer flange 132 cooperate to define a first, generally U-shaped channel or nesting pocket 140 capable of receiving the ends of one wall 122 and associated stiffening flange 124 of the load-bearing header member 22E (FIG. 12A). Likewise, the second inner flange 134, the second outer web portion 136 and the second outer flange 138 define a second nesting pocket 142 substantially similar in structure and function to pocket 140. That is, the generally, U-shaped channel of nesting pocket 142 receives the ends of the other wall 122 and associated stiffening flange 124 of the load-bearing header member 22E. More specifically, the width of each nesting pocket, "$W_7$", must be slightly greater than the width $W_6$ of header member stiffening flanges 124. Similarly, the gross width $W_5$ of the header member 22E must be slightly less than the distance "$W_8$" between the inner faces of the first and second outer flanges 132, 138 of jamb member 14E. And, to enable its reception within the lower and upper channel members 18E, 20E, the gross outer width "$W_9$" of the jamb member 14E must be slightly less than the distance between the flanges of those channel members.

Vertical support for the header member 22E is provided by the jamb member 14E, atop which rests the undersurface of the header web portion 120. The upper channel member 20E caps the assembly. Further, the jamb member, header member and upper channel member are fastened to one another by suitable means similar to those used to connect their counterparts in the previously described embodiments of the present invention.

Framing system 10E offers perhaps the optimum balance of structural strength versus production and assembly costs. The header member 22E and jamb member 14E can be easily roll formed. These members require no coping and can thus be shipped in stock rather than exact lengths. Concomitantly, the necessity of attaching (and possible forming) coped attachment tab(s) in the field is avoided. Additionally, the presence of stiffening flanges 124 contributes significantly to the load bearing capacity of the header member.

Furthermore, all presently contemplated embodiments of the framing system proposed herein permit ready access to the interiors of the load-bearing header members, whereby these members may be easily and quickly filled with insulating material, if desired.

Figure 15:
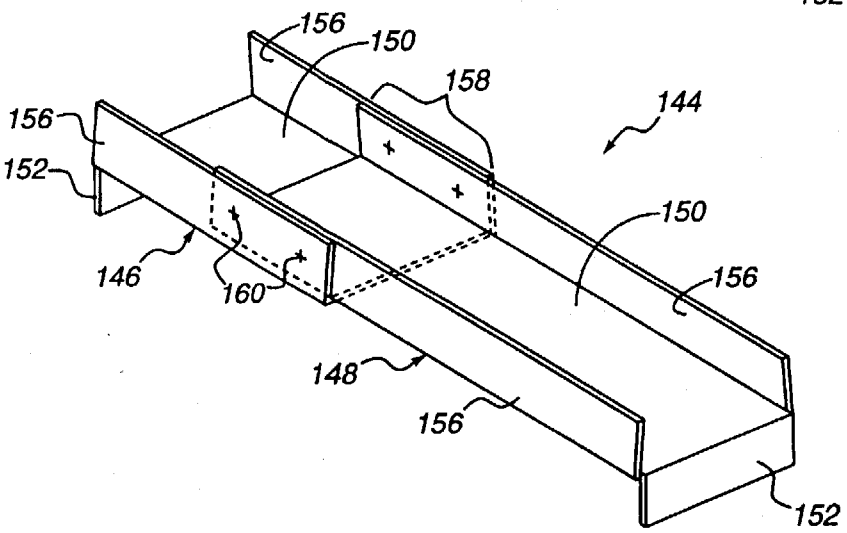
FIG. 15 is an enlarged, perspective view of a first preferred embodiment of a light-gauge metal header/sill member for a window frame subassembly which constitutes a further aspect of the present invention.

Referring to FIG. 15, there is shown an expandable and contractable member 144 adapted to function as either the header or the sill of a non-load-bearing "lateral" window frame subassembly. Such subassembly may be mounted in any suitable structural framing where placement of a window may be desired, including the light-gauge metal structural framing system according to the present invention. The window header/sill member 144 comprises two substantially identical segments 146 and 148 is desirably fabricated from roll formed, light-gauge metal sheet stock such as steel sheet and includes a web portion 150 and attachment means 152 at one end thereof. The attachment means 152 is preferably constructed as a contiguous preformed clip angle which may be secured to a structural jamb member (for example, any of the jamb members described hereinabove) by any of the aforementioned fastening means.

Window sill/header segments 146, 148 further include a pair of flanges or legs 156 projecting from along the side edges of the web portion 150 in a direction generally opposite to that of attachment means 152. The legs 156 are preferably angled or "toed" slightly toward one another to inhibit separation of segments 146, 148 during shipping and assembly. Segments 146, 148 can be of any suitable length. Thus short segments may be used for narrow windows, longer segments may be used for windows of intermediate width, and still longer segments may be employed for very wide windows. In any event, however, there must be substantial overlap between the segments 146, 148, as represented at 158, whereby a considerable range of relative expansion and contraction between the segments may be achieved. And, once the attachment means 152 are secured to their respective jamb members, the overlapping regions of the legs 156 may be affixed to one another by appropriate fastening means, e.g., screws, rivets or spot welds, as indicated by reference numeral 160.

Figure 16:
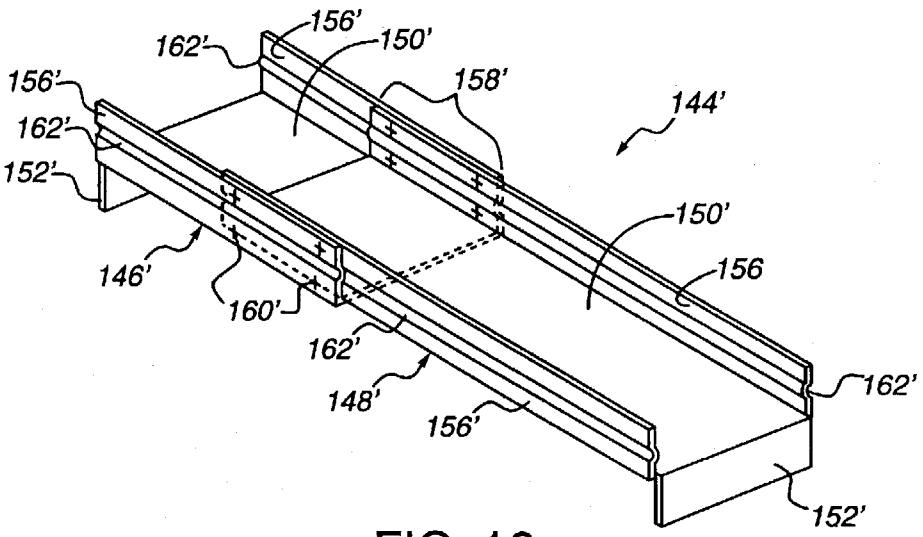
FIG. 16 is an enlarged, perspective view similar to FIG. 15 of a further preferred embodiment of a light-gauge metal header/sill member constructed in accordance with the present invention.

FIG. 16 reveals an alternative construction of the expandable and contractable window header/sill member in accordance with the present invention, identified by reference numeral 144'. Those components of member 144' that are substantially identical in structure and function to the elements discussed in connection with member 144 of FIG. 15 bear corresponding reference numerals and prime (') symbols and will not be described in further detail.

The primary distinction between members 144' and 144 is that the legs or flanges 156' of member 144 are each provided with an elongated rib 162'. This rib serves to structurally reinforce the member 144' as well as reduce the likelihood of unintended separation of the segments during shipping and assembly. In all other respects, however, member 144' is essentially the same as member 144.

The advantages realized by the expandable and contractable window header/sill members 144' and 144 is that they eliminate, for a single window installation, four component pieces and up to twelve labor operations in comparison with the conventional window sill/header assemblies currently employed and depicted in FIGS. 6 and 7. Moreover, members 144' and 144 require no measuring or cutting since they can expand and contract to fit any size window opening within their designated expansion ranges.

While described as it would be assembled at a remote work site, it is also contemplated that the structural framing system of the present invention (and, possibly, the window frame subassembly thereof) may be pre-assembled to desired specifications at a manufacturing facility, whereupon it may be shipped to and erected at the site in modular form.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. Load-bearing metal framing for building construction, said framing comprising:

an upwardly-extending one-piece jamb member;

a downwardly-open one-piece header member having a header web portion and a pair of walls along opposite side edges of said web portion, said pair of walls extending substantially perpendicular from said web portion a first distance to define an opening therebetween for receiving an end of said upwardly extending one-piece jamb member therein such that said header member transfers at least a portion of a load received on said header member to said jamb member, each said wall member of said header member being fixedly attached to said jamb member; and a downwardly-open one-piece upper channel member fixedly connected to at least one of said jamb member and said header member and spanning a juncture of said jamb and header members, said upper channel member having a web portion and a pair of flanges along opposite side edges of said web portion, said pair of flanges extending substantially perpendicular from said web portion a second distance that is shorter than said first distance, wherein said web portion of said header member is in abutting contact with said web portion of said upper channel member and said flanges are in abutting contact with said corresponding walls of said header member to provide lateral support thereto.

2. The metal framing of claim 1 wherein at least one of said jamb member, said header member and said upper channel member is fabricated from steel sheet.

3. The metal framing of claim 2 wherein said steel sheet is roll formed.

4. The metal framing of claim 1 wherein said upper channel member is disposed above said header member.

5. The metal framing of claim 1 wherein said upper channel member is disposed beneath said header member.

6. The load bearing metal framing of claim 1 wherein said jamb member comprises a web portion and a pair of flanges along opposite side edges of said web portion, said pair of flanges extending substantially perpendicular to said web portion such that each said wall of said header member corresponds to a flange of said jamb member for attachment thereto.

7. The metal framing of claim 6 wherein said jamb member further comprises a pair of inwardly directed lips, wherein one of each of said pair of lips extends substantially perpendicular to one of each of said pair of flanges in spaced relation to said web portion.

* * * * *